US010969188B1

(12) United States Patent
Cottingham

(10) Patent No.: US 10,969,188 B1
(45) Date of Patent: Apr. 6, 2021

(54) PISTOL SLIDE-MOUNTED SUPPRESSOR

(71) Applicant: Brent R. Cottingham, Grand Rapids, MI (US)

(72) Inventor: Brent R. Cottingham, Grand Rapids, MI (US)

( * ) Notice: Subject to any disclaimer, the term of this patent is extended or adjusted under 35 U.S.C. 154(b) by 0 days.

(21) Appl. No.: 16/703,339

(22) Filed: Dec. 4, 2019

Related U.S. Application Data

(60) Provisional application No. 62/775,189, filed on Dec. 4, 2018.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325
USPC ..... 89/14.4; 181/223
See application file for complete search history.

(56) References Cited

U.S. PATENT DOCUMENTS 3,978,762 A * 9/1976 Khaidurov ..... F41A 21/36 89/14.3
4,207,799 A * 6/1980 Tocco ..... F41A 21/325 89/14.3
4,479,418 A * 10/1984 Beretta ..... F41A 21/30 89/14.4
4,691,614 A * 9/1987 Leffel ..... F41A 21/36 89/14.3
4,709,497 A * 12/1987 Resca ..... F41A 21/32 42/7
5,136,924 A * 8/1992 Förster ..... F41A 21/30 89/14.4
5,164,535 A * 11/1992 Leasure ..... F41A 21/30 181/223
5,679,916 A * 10/1997 Weichert ..... F41A 21/30 181/223
10,082,354 B1 * 9/2018 Lee ..... F41A 21/481
2010/0024274 A1 * 2/2010 Lippard ..... F41A 21/36 42/70.05
2011/0088540 A1 * 4/2011 Brittingham ..... F41A 21/30 89/14.5
2013/0168181 A1 * 7/2013 Wirth ..... F41A 21/30 181/223
2013/0319790 A1 * 12/2013 Bladen ..... F41A 21/30 181/223

(Continued)

*Primary Examiner* — Bret Hayes
(74) *Attorney, Agent, or Firm* — Gardner, Linn, Burkhart & Ondersma LLP

(57) ABSTRACT

A firearm suppressor configured for coupling to a firearm with its stock barrel bushing removed. The firearm suppressor includes a barrel bushing feature, a recess, and a release. The barrel bushing feature duplicates the barrel bushing of the firearm, which constrains the movement of the barrel of the firearm. The recess is positioned below the barrel bushing and is configured to receive and retain a cap of a recoil spring plug of the firearm. The firearm suppressor is coupled to the firearm when the cap of the recoil plug of the firearm is retained in the recess. The release is configured to press against the recoil spring plug of the firearm. Actuating the release pushes the recoil spring plug of the firearm away from the firearm suppressor, such that the firearm suppressor is removable from the firearm in the same manner as the original barrel bushing.

20 Claims, 6 Drawing Sheets

(56) References Cited

U.S. PATENT DOCUMENTS

| | | | | |
|---|---|---|---|---|
| 2014/0224575 | A1* | 8/2014 | Latka | F41A 21/30<br>181/223 |
| 2015/0253098 | A1* | 9/2015 | Russell | F41A 21/30<br>89/14.4 |
| 2017/0131065 | A1* | 5/2017 | Whitson | F41G 1/01 |
| 2017/0205178 | A1* | 7/2017 | Niswander | F41A 21/36 |
| 2019/0101350 | A1* | 4/2019 | Hall | F41A 21/325 |
| 2019/0242668 | A1* | 8/2019 | Barrett | F41A 21/28 |

* cited by examiner 300
314
313
312

100

310

100
130
132
134
316

313
312
314

132

PISTOL SLIDE-MOUNTED SUPPRESSOR

CROSS-REFERENCE TO RELATED APPLICATIONS

The present application claims the filing benefit of U.S. Provisional Application, Ser. No. 62/775,189, filed Dec. 4, 2018, which is hereby incorporated herein by reference in its entirety.

FIELD OF THE INVENTION

The present invention is directed to pistol suppressors, and in particular, pistol suppressors with integrated barrel bushings for coupling with stock barrels.

BACKGROUND OF THE INVENTION

Conventional firearm suppressors are muzzle-mounted devices that reduce sound intensity when the firearm is discharged. Suppressors may be detachably coupled to, or an integral part of, the barrel of the firearm. Detachable suppressors may be equipped with "female" threads on the end of the suppressor for engaging with matching threads on the barrel of the firearm. However, most firearms don't come with threaded barrels for attaching muzzle-mounted accessories. Therefore, conventional suppressors require any firearm to be retrofitted with a threaded barrel.

SUMMARY OF THE INVENTION

Embodiments of the present invention provide a detachable suppressor with an integrated barrel bushing configured to couple to a firearm without modification of the firearm. The integrated barrel bushing of the detachable suppressor replaces the factory supplied barrel bushing of the firearm whereby the suppressor is readily connectable to the firearm.

In a particular embodiment, a release coupled to a recoil spring plug plunger is configured to extend the recoil spring plug plunger when levers of the release are pressed. Extending the recoil spring plug plunger presses against a cap of the recoil spring plug and pushes the recoil spring plug away from the suppressor, allowing the integrated barrel bushing to rotate for detachment. When the detachable suppressor is coupled to the firearm, the cap of the recoil spring plug is snapped into a recess on the suppressor.

In an aspect of the present invention, a detachable suppressor is configured for coupling to a firearm. The firearm's stock barrel bushing is removed and replaced by the integrated barrel bushing of the suppressor. The integrated barrel bushing of the suppressor is configured for coupling the suppressor to a firearm. The suppressor includes a recess well positioned below the integrated barrel bushing and configured for receiving a cap of the recoil spring plug of the pistol.

In a further aspect of the present invention, the suppressor includes a release comprising a pair of wings configured to extend a recoil spring plug plunger when the wings are pressed. Extending the recoil spring plug plunger presses against a cap of the recoil spring plug and pushes the recoil spring plug away from the suppressor and allows the suppressor to be rotated for detachment.

In another aspect of the present invention, the suppressor includes a suppressing mechanism for suppressing a sound intensity of a discharge of the firearm. The suppressing mechanism may include at least one of baffles, noise absorbing structures, and liquid impregnated materials.

In a further aspect of the present invention, a cross-sectional outline of the suppressor is similar to a cross-sectional outline of the slide of the pistol. Alternatively, the cross-sectional outline of the suppressor may vary from the slide outline if such an outline allows the slide and attached suppressor to mechanically function normally.

These and other objects, advantages, purposes and features of the present invention will become apparent upon review of the following specification in conjunction with the drawings.

DESCRIPTION OF THE PREFERRED EMBODIMENTS

Figure 1:
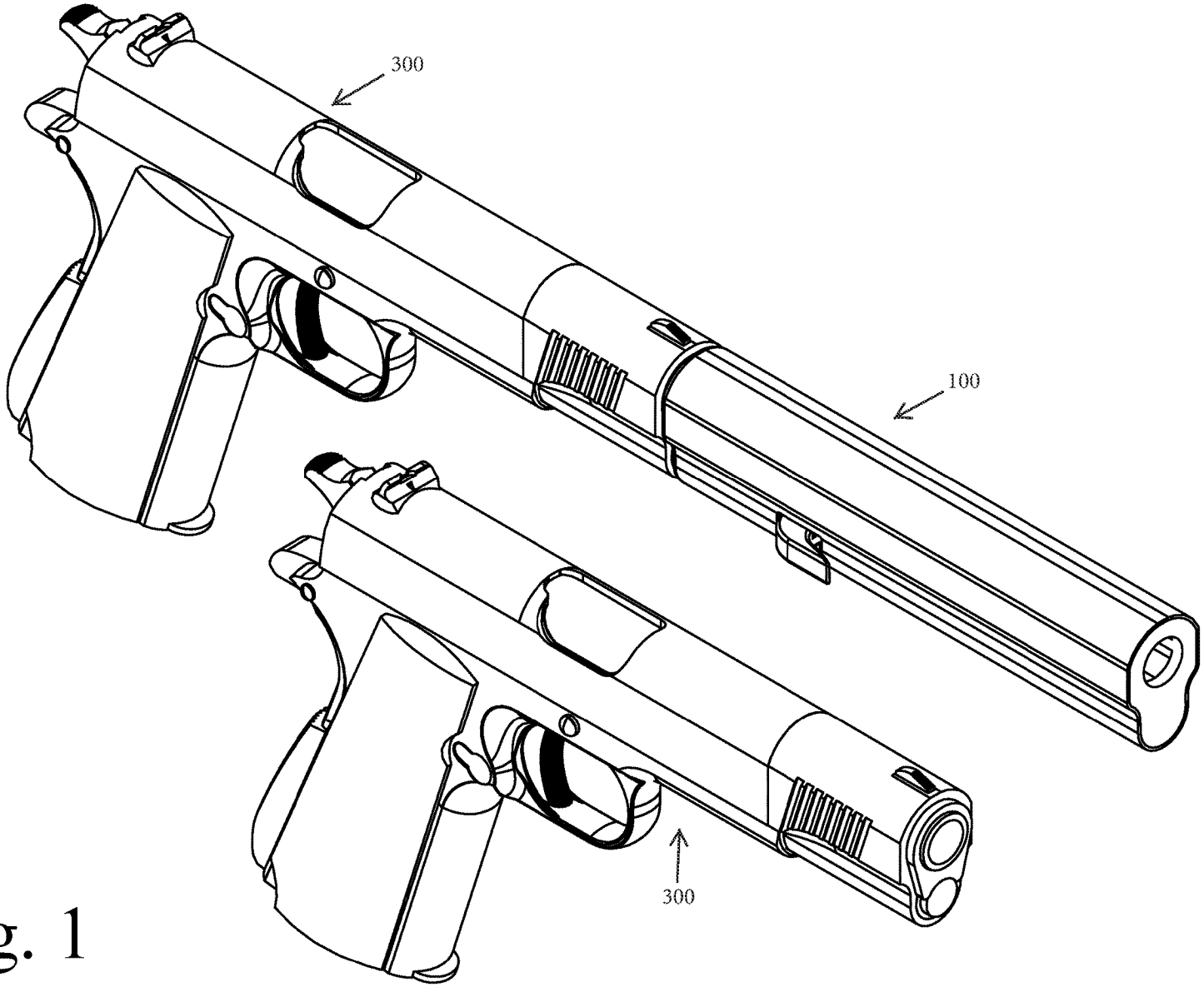
FIG. 1 is a side-by-side perspective view of a suppressor-equipped pistol and an unequipped pistol in accordance with the present invention.

Referring to the drawings and the illustrative embodiments depicted therein, an exemplary detachable suppressor includes an integrated barrel bushing such that the suppressor is configured for coupling to a conventional, factory-stock firearm without substantial adjustment or modification (e.g., without a threaded barrel). As discussed herein, the suppressor with integrated barrel bushing of the present invention is configured to replace a conventional or "stock" barrel bushing of the firearm. The suppressor also includes a recess well that is positioned below the integrated barrel bushing. The recess well is configured for receiving a cap or head of a recoil spring plug of the pistol. When the integrated barrel bushing is firmly in place and the cap/head of the recoil spring is snapped into the recess well, the suppressor of the present invention will be coupled to the firearm and capable of suppressing the sound intensity of the firearm's discharge. Pressing together the opposing wings of a thumb release of the suppressor extends a recoil spring plug plunger to press against the recoil spring plug cap/head and pushes the recoil spring plug away from the suppressor allowing the suppressor to be rotated for releasing the integrated barrel bushing and detachment of the suppressor. Therefore, by removing a standard or stock barrel bushing of a pistol, the suppressor of the present invention may be coupled to a standard barrel of the firearm without requiring the replacement of the standard barrel or requiring extensive modification of the firearm.

FIG. 1 illustrates a side-by-side comparison of a pistol 300, with and without an exemplary suppressor 100. FIG. 1 illustrates an M1911A1 .45 caliber automatic pistol. While the exemplary pistol is an M1911 pistol, other firearm models may be used that incorporate barrel bushings of the same design. As discussed herein, when the standard barrel bushing (i.e., the factory or stock barrel bushing) of the pistol 300 is removed, the detachable suppressor 100 may be detachably coupled to the pistol 300 without the need for any further modification of the pistol 300. As described herein, the detachable suppressor 100 includes an integrated barrel bushing 130 (see FIG. 2).

This exemplary suppressor 100 differs from the conventional suppressor in that it is not attached to the barrel (e.g., via a threaded barrel or other coupling methods), but mounts to the slide of any firearm that follows the design practice utilized principally in the exemplary M1911 pistol. The barrel 302 of that pistol 300 is mounted into a slide 310 by a barrel lock and pin on the receiver end and a barrel bushing on the other (see FIG. 3). The conventional "stock" barrel bushing (i.e., the barrel bushing that is part of the original factory assembly) is configured to allow the barrel to both slide through the barrel bushing and to rotate up and down slightly during the pistol's functioning. The exemplary suppressor 100 is configured such that the mounting end (130) of the suppressor 100 precisely duplicates the geometry of the stock barrel bushing and replaces it when mounted onto the slide 310 of the pistol 300. The suppressor 100 also duplicates the function of the stock barrel bushing in that the suppressor 100 locks the pistol's recoil spring plug 312 into its appropriate position (e.g., a recoil plug receptacle) within the pistol slide 310.

Figure 2:
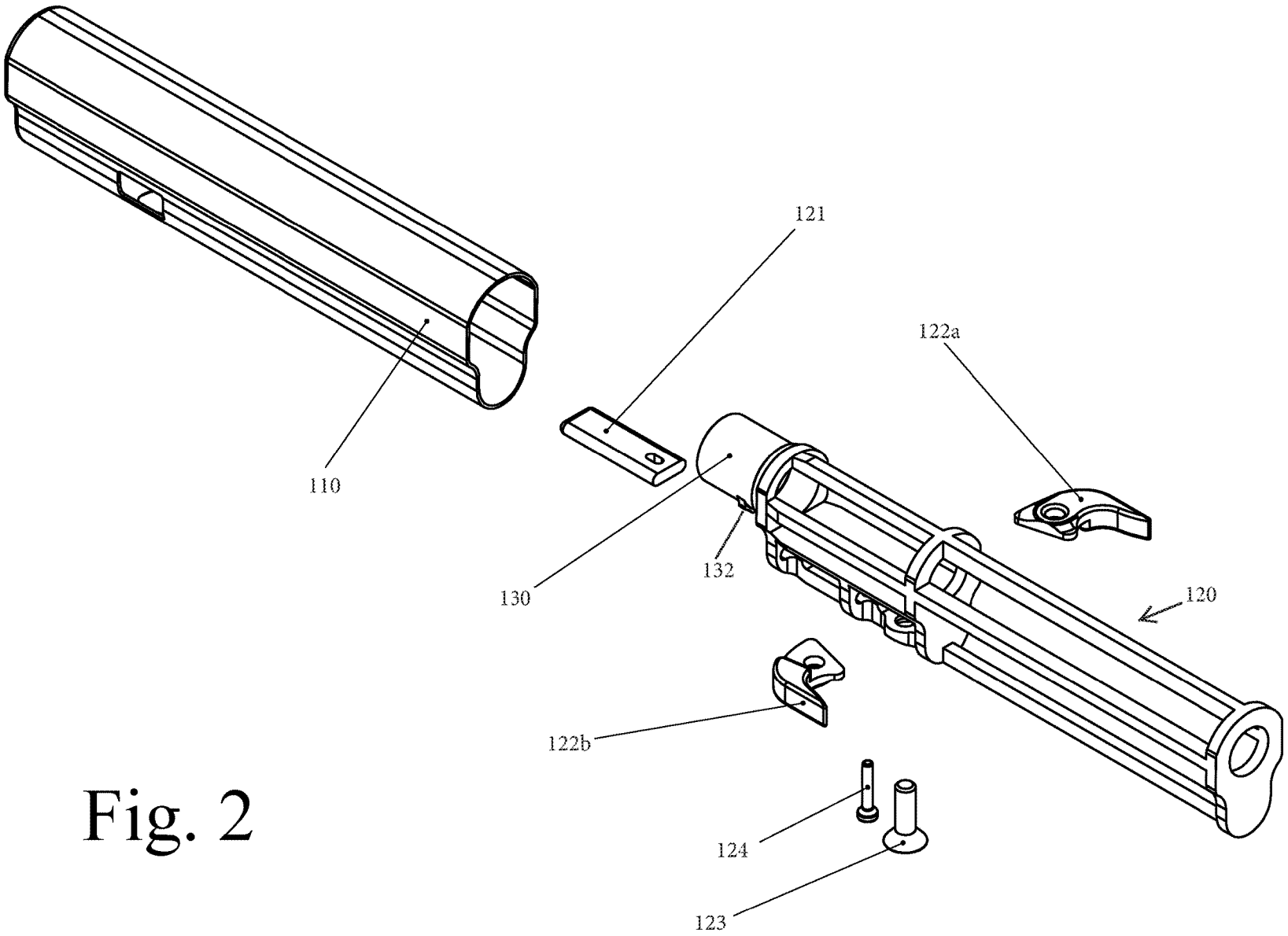
FIG. 2 is an exploded view of the suppressor of FIG. 1 in accordance with aspects of the present invention.

FIG. 2 illustrates an exploded view of the suppressor 100. The suppressor 100 includes an elongate suppressor member that may include an exterior casing or housing 110 that slidably covers the elongated internal structure of the suppressor 100, which in the illustrated embodiment includes an internal suppressor frame 120. The internal suppressor frame 120 has an elongated tubular construction with cavities that may be used for receiving noise suppressant elements. In one embodiment the internal suppressor frame 120 has a metallic construction. In other embodiments, other materials may be used for the suppressor frame 120, as well as for the exterior casing/housing 110. In one embodiment, the suppressor 100 is configured with a cross-sectional outline similar to the cross-sectional outline of the slide 310 of the pistol 300. In another embodiment, the suppressor 100 is configured with a cross-sectional outline dissimilar to the cross-sectional outline of the slide 310 of the pistol 300. Other cross-sectional outlines are also possible, including larger profiles to enable use of additional noise suppressants. As illustrated in FIG. 2, the exterior casing/housing 110 has a cross-sectional outline that closely matches the cross-sectional outline of the internal structure 120, such that the exterior casing/housing 110 slides over the internal structure 120 with a close fit and without excess space. Although the elongate suppressor member is illustrated as comprising a separate housing 110 and internal structure, in an alternative arrangement the internal structure may be formed to integrally include the exterior surface of the suppressor.

A release 122 is connected with the suppressor frame 120 for disconnecting the suppressor 100 from the pistol 300. In the illustrated embodiment the release 122 comprises a thumb release that includes a pair of levers or tabs 122*a*, 122*b* engaged with the suppressor frame 120 and held with a screw 123. Pressing the levers 122*a*, 122*b* causes them to rotate and engage in a cam like action against a recoil spring plug plunger 121 that is retained to the suppressor frame 120 with a pin 124 via a slot 602 (see FIGS. 6A and 6B). In the illustrated embodiment the recoil spring plug plunger 121 has a flat rectangular construction. In other embodiments, the recoil spring plug plunger 121 may have other constructions, such as of a cylindrical or pillar construction, or other similar constructions. The recoil spring plug plunger 121 may also have a metallic construction. Optionally, the recoil spring plug plunger 121 may have a hard plastic or other similar construction. Although release 122 is shown in the illustrated embodiment as a thumb release, it should be appreciated that alternative release mechanisms may be employed for removing suppressor 100 from pistol 300, including slide mechanisms, or the like.

The internal suppressor frame 120 illustrated in FIG. 2 also includes an exemplary sound suppression means for reducing the sound intensity of the firearm discharge via the formation of various cavities within the frame 120. Other embodiments of the sound suppression means are also possible. For example, the internal suppressor frame 120 may include or be provided with any variety of sound suppression mechanisms or materials (or any combination of such sound suppression mechanisms or materials), such as baffles, noise absorbing structures or materials, and liquid impregnated materials, as well as other methods for suppressing the discharge of the equipped firearm. Optionally, the suppressor 100 may be a single unit with the exterior casing/housing 110 integrated into, or onto, the interior structure 120 of the suppressor 100. For example, the outer surface of the interior structure 120 may be the exterior casing/housing 110 of the suppressor 100.

Figure 3:
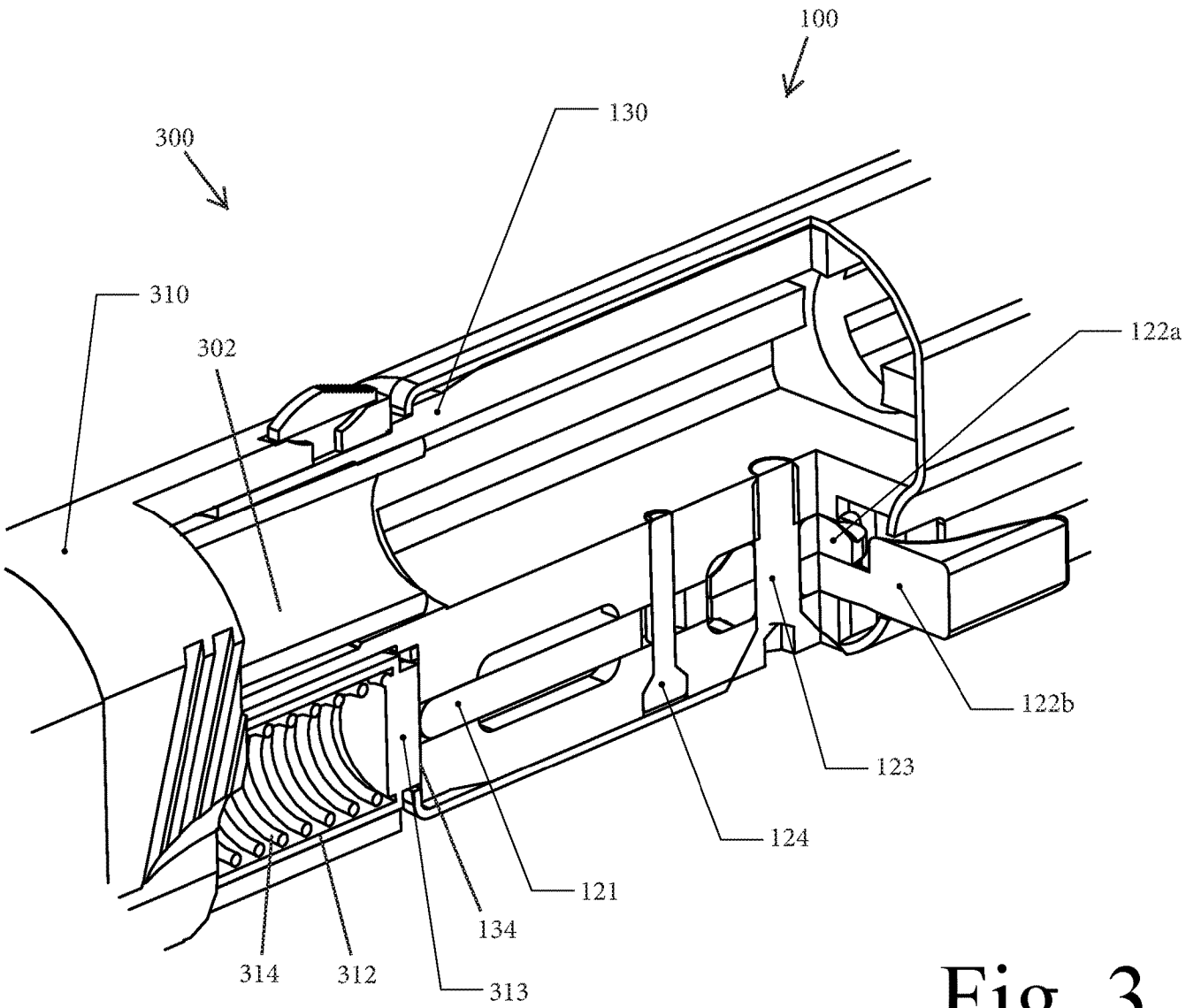
FIG. 3 is a cutaway view of the suppressor of FIG. 1 mounted on the pistol of FIG. 1 in accordance with the present invention.

FIG. 3 illustrates a cutaway view of the suppressor 100 mounted on the pistol 300. FIG. 3 illustrates how the suppressor 100 couples to the pistol slide 310, replacing the original stock barrel bushing, and locking onto the cap 313 of the recoil spring plug 312 (by the cap 313 settling into the recess well 134). FIG. 3 also illustrates how the screw 123 retains the levers 122*a*, 122*b* of the thumb release 122. The cutaway view of FIG. 3 also illustrates the pin 124 sliding through the slot 602 in the recoil spring plug plunger 121. FIG. 3 also illustrates the cap 313 of the recoil spring plug 312 retained in a recess well 134 of the suppressor 100.

FIG. 3 illustrates how the barrel bushing 130 of the suppressor 100 slides over the barrel 302 of the pistol 300 and positions the recess well 134 before the recoil spring plug 312. The cutaway view of FIG. 3 illustrates how the recoil spring 314 is retained within a cavity of the recoil spring plug 312. A combination of the barrel bushing's locking key 132 being retained in the locking key slot 316 (FIG. 4A) and the pressure of the recoil spring 314 keeping the cap 313 of the recoil spring plug 312 snapped into the recess well 134, works to retain the suppressor 100 in a position to suppress the firearm's discharge. That is, the barrel bushing 130 is retained over the barrel 302 of the pistol 300 when the locking key 132 of the barrel bushing 130 is engaged with the locking key slot 316 in the pistol slide 310 and the recoil spring plug cap 313 is retained in the recess well 134 (see FIG. 3).

Figures 4A, 4B, 4C, 4D, 4E, 4F, 4G, 4H, 4I, 4J, 4K:
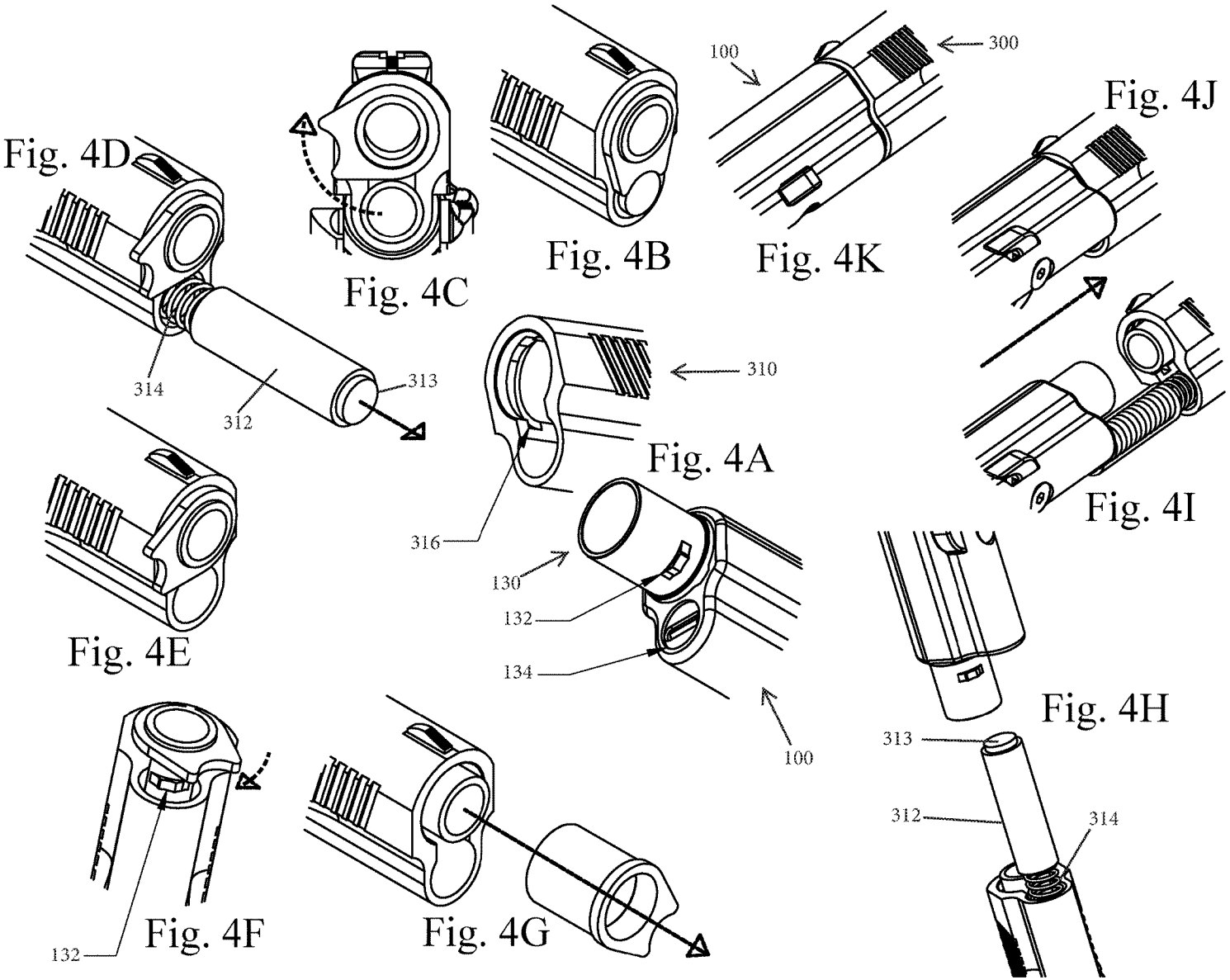
FIGS. 4A-4K illustrate a step-by-step process for coupling the suppressor of FIG. 1 to the pistol of FIG. 1 in accordance with the present invention.

FIG. 4A illustrates the end of the slide 310 showing the locking key slot 316 positioned for receiving the locking key 132 on the barrel bushing 130 of the suppressor 100. As illustrated in FIG. 4A, the locking key slot 316 is a channel or groove with an opening off a spring plug receptacle of the slide 310 configured for receiving the recoil spring 314 and recoil spring plug 312. A mounting end (the barrel bushing 130) of the suppressor 100, illustrated in FIG. 4A, is shaped to replace the original "stock" barrel bushing. As illustrated in FIG. 4A, the locking key 132 is shaped to be received by the locking key slot 316.

FIGS. 4A-4K illustrate a step-by-step process for removing a stock barrel bushing of the pistol 300 and coupling the suppressor 100 to the pistol 300. FIG. 4B illustrates the pistol 300 with a stock or standard barrel bushing. In other words, the pistol 300 is completely assembled in the typical way. FIG. 4C illustrates the stock barrel bushing rotated clockwise to release the recoil spring plug 312 of the pistol 300. FIG. 4D illustrates the pistol's recoil spring plug 312 and recoil spring 314 being removed from the pistol's slide 310. FIG. 4E illustrates the pistol 300 with the recoil spring plug 312 and the recoil spring 314 removed. FIG. 4F illustrates the pistol's barrel bushing removal from the pistol's slide 310. As also illustrated in FIG. 4F, the original (or conventional) barrel bushing is rotated counterclockwise until the original barrel bushing's locking key has left the locking key slot 316 in the slide 310 and is aligned with the spring plug receptacle of the slide 310. FIG. 4G illustrates the stock or conventional barrel bushing being removed from the pistol 300.

FIG. 4H illustrates the recoil spring 314 and the recoil spring plug 312 returned to the slide 310, and the suppressor 100 rotated and oriented such that the barrel bushing 130 of the suppressor 100 will fit into the slide 310 of the pistol 300 (that is, the locking key 132 is oriented for the recoil spring plug receptacle of the slide 310). FIG. 4I illustrates the suppressor 100 moved towards its mounting position until it makes contact with a cap/head 313 of the recoil spring plug 312, preparatory to being pushed into the slide 310 of the pistol 300. FIG. 4J illustrates the suppressor 100 having been pushed towards the slide 310 until it makes contact with the face of the slide 310, having forced the recoil spring plug 312 back into the slide 310 as well. Finally, in FIG. 4K, the suppressor 100 is rotated clockwise until the cap/head 313 is seated into the recess well 134.

Figure 5A:
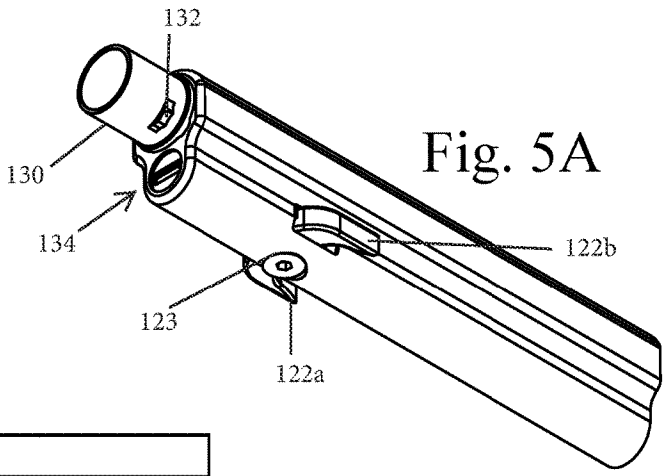
FIGS. 5A-5F are perspective, top, side, bottom and end views of the suppressor of FIG. 1 in accordance with the present invention.
Figure 5B:
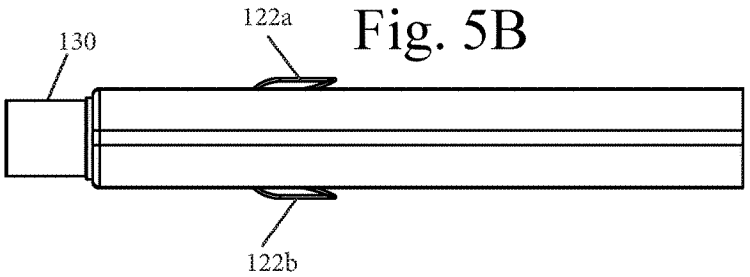
Figure 5C:
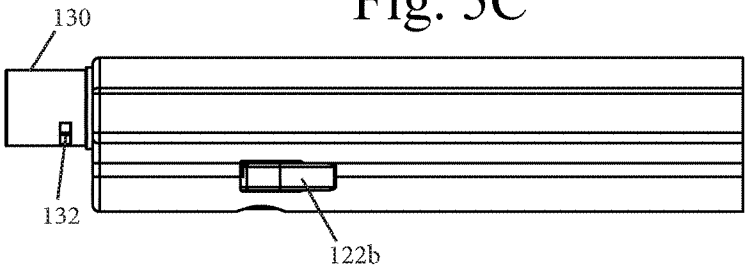
Figure 5D:
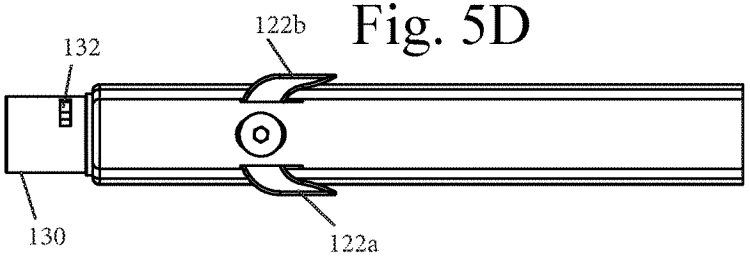
Figure 5F:
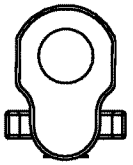
Figure 5E:
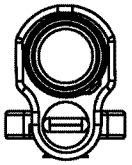

FIGS. 5A-5D include a variety of views of the suppressor 100. As illustrated in FIGS. 5A-5D, a pair of levers 122*a*, 122*b* are arranged on opposite sides of the suppressor 100. The barrel bushing 130 with locking key 132 is arranged above the recess well 134. As illustrated in FIG. 5A, the screw 123 is inserted through the exterior casing 110, while the pin 124 is retained within the interior frame 120 by the exterior casing 110. FIGS. 5E and 5F illustrate opposing ends of the suppressor 100, with FIG. 5E depicting the end of the suppressor 100 facing the slide 310 of the pistol 300.

Figure 6A:
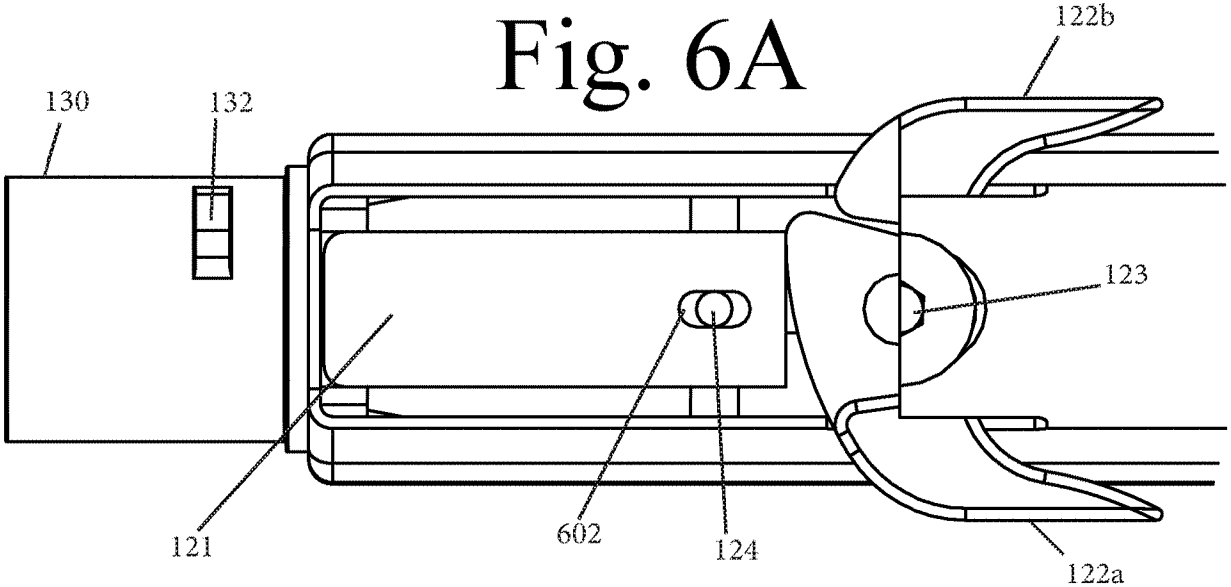
FIGS. 6A and 6B are cutaway views of the suppressor of FIG. 1 illustrating a release mechanism of the suppressor in accordance with an aspect of the present invention.
Figure 6B:
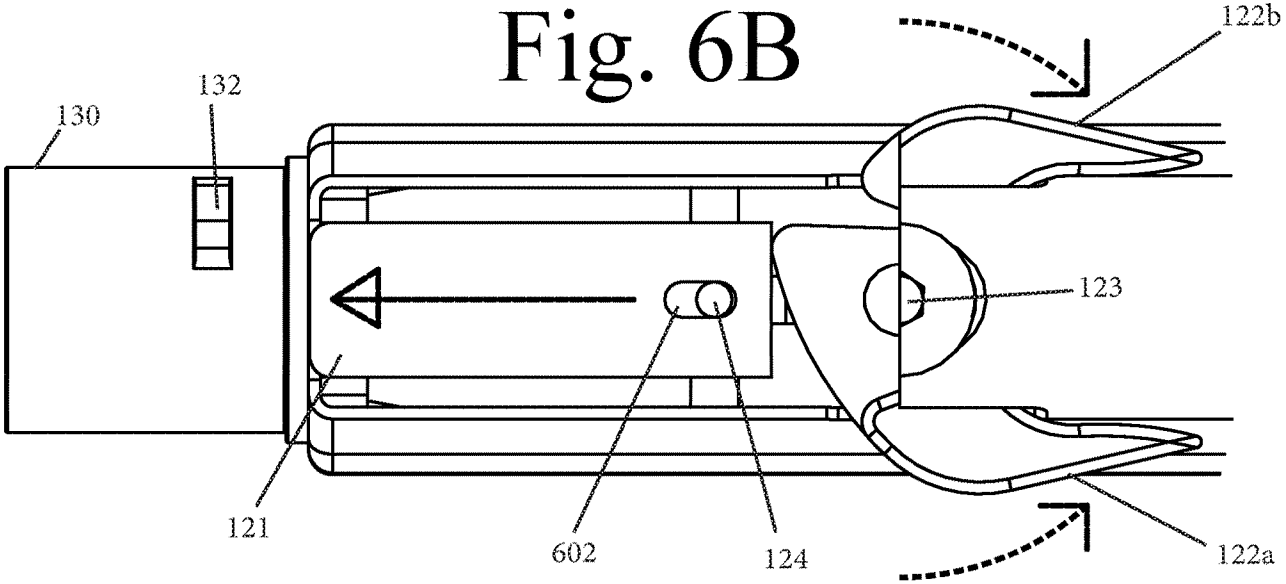

FIGS. 6A and 6B illustrate the operation of the slidably adjustable recoil spring plug plunger 121 when impacted by the scissoring operation of the levers 122*a*, 122*b* of the release 122. When the recoil spring plug plunger 121 is impacted by the leading edge(s) of the release 122, the recoil spring plug plunger 121 will slide forward. Note that the recoil spring plug plunger 121 includes a slot 602 through which a retaining pin 124 is inserted. As illustrated in FIGS. 6A and 6B, the linear motion of the recoil spring plug plunger 121 is limited by the pin 124 in the slot 602 (that is, the linear motion is limited to the length of the slot 602). As illustrated in FIG. 6A, when the release 122 is released, the recoil spring plug plunger 121 is in a resting position and out of the recess well 134. FIG. 6B illustrates the release 122 compressed and extending the recoil spring plug plunger 121 into the recess well 134. As discussed herein, when the recoil spring plug plunger 121 has been pushed into the recess well 134, the recoil spring plug 312 will be pushed back from the suppressor 100, allowing the suppressor 100 to be removed (i.e., the integrated barrel bushing 310 may be rotated). In an alternative embodiment, the release 122 may be configured as a thumb slide that uses a longitudinal action for controlling the motion of the recoil spring plug plunger 121.

Because the integrated barrel bushing 130 of the suppressor 100 replaces the "stock" barrel bushing of the pistol 300, the suppressor 100 may be removably coupled to a stock (factory assembled) pistol without having to further modify the pistol (other than removing the stock barrel bushing). For example, conventional suppressors are often fitted with female threads that engage with matching threads on the end of the barrel. Because stock barrels don't usually come with threads (for the attachment of accessories), the stock barrel of a pistol will need to be replaced with a threaded barrel when a conventional suppressor is to be mounted to the pistol. In other words, the exemplary suppressor 100 of the present invention requires no significant modification to a pistol (such as the exemplary M1911-style firearm) at all, since the suppressor 100 replaces the stock barrel bushing, allowing the suppressor 100 to be coupled to the pistol 300 without replacing the stock barrel with a threaded barrel.

Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. A firearm suppressor configured for coupling to a firearm comprising:

an elongate suppressor member having a passage there through;

a barrel bushing extending from an end of the elongate suppressor member with the barrel bushing configured for engaging with a barrel of a firearm, with the firearm including a recoil spring plug having a cap and including a slide with a locking key slot disposed therein;

a recess positioned below the barrel bushing and configured for receiving and retaining the cap of the recoil spring plug of the firearm, wherein the firearm suppressor is coupled to the firearm when the cap of the recoil spring plug of the firearm is retained in the recess and the barrel bushing is engaged with the barrel of the firearm; and wherein the firearm suppressor further includes a release configured to press against the recoil spring plug of the firearm, wherein actuating the release pushes the recoil spring plug of the firearm away from the firearm suppressor, such that the firearm suppressor is removable from the firearm.

2. The firearm suppressor of claim 1, wherein the barrel bushing comprises a locking key configured for engaging with the locking key slot of the slide of the firearm.

3. The firearm suppressor of claim 1, wherein the release comprises a pair of levers retained with a screw.

4. The firearm suppressor of claim 3 further comprising a recoil spring plug plunger configured for contacting the cap of the recoil spring plug, wherein actuating the pair of levers of the release causes the release to contact and push the recoil spring plug plunger in a linear direction.

5. The firearm suppressor of claim 4, wherein the recoil spring plug plunger comprises a slot for defining the linear travel of the recoil spring plug plunger, and wherein the recoil spring plug plunger is retained with a pin that is positioned in the slot.

6. The firearm suppressor of claim 1, wherein the elongate suppressor member further comprises a suppressing mechanism configured for suppressing a sound intensity of a discharge of the firearm.

7. The firearm suppressor of claim 6, wherein the suppressing mechanism comprises at least one of baffles, noise absorbing structures, and liquid impregnated materials.

8. The firearm suppressor of claim 7 further comprising an exterior casing configured for retaining and enclosing the suppressing mechanism.

9. The firearm suppressor of claim 1, wherein the firearm is configured as an M1911 automatic pistol.

10. The firearm suppressor of claim 1, wherein an end of the barrel of the firearm is unthreaded.

11. The firearm suppressor of claim 1, wherein a cross-sectional outline of the elongate suppressor member is similar to a cross-sectional outline of the slide of the firearm.

12. The firearm suppressor of claim 1, wherein the elongate suppressor member comprises an exterior casing and an internal frame, and wherein the external casing and internal frame may be either separate components or integrally formed.

13. A firearm suppressor configured for coupling to a firearm that includes a recoil spring plug having a cap and includes a slide with a locking key slot disposed therein, the firearm suppressor comprising:

a barrel bushing configured for sliding over a portion of a barrel of the firearm, wherein the barrel bushing comprises a locking key configured to engage with the locking key slot in the slide of the firearm;

a recess oriented below the barrel bushing and configured to receive and retain the cap of the recoil spring plug of the firearm, wherein the firearm suppressor is coupled to the firearm when the locking key of the barrel bushing is engaged in the locking key slot of the slide of the firearm and the cap of the recoil plug of the firearm is retained in the recess; and a release configured to press against the recoil spring plug of the firearm, wherein actuating the release pushes the recoil spring plug of the firearm away from the firearm suppressor, such that the firearm suppressor is removable from the firearm.

14. The firearm suppressor of claim 13 further comprising an internal suppressing mechanism configured for suppressing a sound intensity of a discharge of the firearm, wherein the internal suppressing mechanism comprises at least one of baffles, noise absorbing structures, and liquid impregnated materials.

15. The firearm suppressor of claim 13, wherein the firearm is configured as an M1911 automatic pistol.

16. The firearm suppressor of claim 13, wherein an end of the barrel of the firearm is unthreaded.

17. The firearm suppressor of claim 13, wherein a cross-sectional outline of the firearm suppressor is similar to a cross-sectional outline of the slide of the firearm.

18. The firearm suppressor of claim 13 further comprising an exterior casing and an internal frame, and wherein the external casing and internal frame may be either separate components or integrally formed.

19. A firearm suppressor comprising:

an elongate suppressor member comprising an external casing and an internal frame and having a passage there through;

a barrel bushing extending from an end of the elongate suppressor member, wherein the barrel bushing includes an outwardly projecting locking key;

a recess positioned below the barrel bushing;

a recoil spring plug plunger positioned at the recess;

a moveable release configured to contact and extend the recoil spring plug plunger into the recess; and wherein the elongate suppressor member comprises at least one of baffles, noise absorbing structures, and liquid impregnated materials.

20. The firearm suppressor of claim 19, wherein the release comprises a pair of levers or a slide and the recoil spring plunger includes a slot and is retained with a pin positioned within the slot, and wherein the slot defines a linear direction of travel of the recoil spring plunger, and wherein the barrel bushing is configured for sliding over a portion of a barrel of a firearm, wherein the locking key of the barrel bushing is configured to engage with a locking key slot in a slide of the firearm, wherein the recess is configured to receive and retain a cap of a recoil spring plug of the firearm, and wherein the release is configured to press against the recoil spring plug of the firearm.

* * * * *